US005478120A

United States Patent [19]

D'Andrea

[11] Patent Number: 5,478,120

[45] Date of Patent: Dec. 26, 1995

[54] METHOD OF MAKING A PUBLICATION AND PRODUCT PRODUCED THEREBY

[76] Inventor: Deborah B. D'Andrea, 110 Twin Oaks Rd., Akron, Ohio 44313

[21] Appl. No.: 109,490

[22] Filed: Aug. 20, 1993

Related U.S. Application Data

[63] Continuation-in-part of Ser. No. 922,526, Jul. 31, 1992, Pat. No. 5,238,345.

[51] Int. Cl.[6] ..... B42C 19/00

[52] U.S. Cl. ..... 283/117; 283/63.1; 283/67; 412/4; 281/15.1

[58] Field of Search ..... 283/117, 63.1; 412/2, 4; 281/15.1

[56] References Cited

U.S. PATENT DOCUMENTS

| | | | |
|---|---|---|---|
| 1,033,576 | 7/1912 | Garman . | |
| 2,489,240 | 11/1949 | Meyer | 281/15.1 X |
| 3,622,771 | 4/1971 | Franc . | |
| 3,892,427 | 7/1975 | Kraynak et al. . | |
| 3,982,744 | 9/1976 | Kraynak et al. . | |
| 4,176,473 | 12/1979 | Rae | 281/15.1 X |
| 4,200,867 | 4/1980 | Hill . | |
| 4,616,327 | 10/1986 | Rosewarne et al. . | |
| 4,857,955 | 8/1989 | Crandall . | |
| 4,928,243 | 5/1990 | Hodges et al. . | |
| 4,974,171 | 11/1990 | Yeh et al. . | |
| 5,009,626 | 4/1991 | Katz . | |
| 5,018,085 | 5/1991 | Smith, Jr. . | |
| 5,031,935 | 7/1991 | D'Andrea . | |
| 5,036,472 | 7/1991 | Buckley et al. . | |
| 5,056,029 | 10/1991 | Cannon . | |
| 5,114,291 | 5/1992 | Hefty . | |
| 5,205,591 | 4/1993 | Lorenz | 283/117 |
| 5,213,461 | 5/1993 | Kalisher | 283/117 X |

OTHER PUBLICATIONS

Two–page sales brochure from CAR–PEC Graphics entitled "Keeping Up with the Changes" (date unknown).

"Disney's Beauty and the Beast," Golden's Giant Sticker Fun (date unknown).

*Primary Examiner*—Timothy V. Eley
*Assistant Examiner*—Khan V. Nguyen
*Attorney, Agent, or Firm*—Oldham & Oldham

[57] ABSTRACT

A publication designed to receive a photograph of a subject, such as a child, so that the subject in the photograph forms a part of the illustrations on the pages of the publication. The publication is designed to allow the subject to be identified with a particular organization of an association. For example, the publication may be designed to allow the subject to be identified as a player of a particular team within a football, basketball, baseball, or other sports league. The invention also relates to a publication produced using a computer to manipulate image data stored on a CD-ROM or the like so that the image data generic to each organization within an association can be easily enhanced and customized to depict one or more particular organizations within the association, such as one or more particular football teams within a football league. In this manner, a variety of different publications may be easily produced so that a subject may be identified with any organization within an association, for example, as a member of a sports team within a league. The publication may also include a sports card as a part thereof such that the face of the subject in the photograph forms a part of the illustration on the sports card.

16 Claims, 7 Drawing Sheets

METHOD OF MAKING A PUBLICATION AND PRODUCT PRODUCED THEREBY

This application is a continuation-in-part of U.S. Pat. No. 5,238,345 issued Aug. 24, 1993 which is incorporated herein by reference.

FIELD OF THE INVENTION

This invention relates to a method of manufacturing a publication which associates or identifies a subject with a particular one of a plurality of organizations within a common association. More particularly, this invention relates to a method wherein generic graphic indicia, common to each of the organizations, is placed on sheets of paper or other means for storing a tangible medium of expression and the generic graphic indicia is subsequently enhanced by superimposing additional indicia to depict a particular one of a plurality of organizations within an association. This invention further relates to providing means for additionally identifying or associating a subject with the particular organization or a member within the particular organization.

BACKGROUND ART

The use of computer printing to insert personalized data into a preprinted text of a book, such as a child's name, address, friend's names and data of a personal nature, is known. An example of a method for personalizing preprinted text is disclosed in U.S. Pat. No. 3,982,744 and 3,982,427 to Kraynak. U.S. Pat. No. 5,036,472 additionally discloses typing in information on a preprinted greeting card so as to personalize the card. Computer programs for generating and combining for reproduction on a single format having standardized text and graphics or personalized text and graphics are known, per se, as shown in the Rosewarne et al. U.S. Pat. No. 4,616,327. Also known are electronic printers operated by a computer software program which print certain portions of the text in a color different from the remainder of the text. See U.S. Pat. No. 4,857,955. Moreover, U.S. Pat. No. 4,974,171 to Yeh et al. discloses a memory system for enhancing the transference of data from a data source to a printer. The memory system provides memory designations for four different types of data relating to text, fill areas, images and line graphics so that the most efficient memory storage means can be used for each type of data.

U.S. Pat. No. 5,031,935 discloses a book for young readers which contains pages with apertures cut therein, such that the apertures are capable of superimposing images affixed to the front and rear covers. The pages contain illustrations and/or text on the front and rear surface.

BACKGROUND DISCUSSION

Various associations, such as professional sports associations or leagues (e.g., NBA, NFL, NHL, MLB, etc.), have gained a high degree of popularity and recognition among people of all ages. Also organizations within these associations, such as the teams within particular cities, typically have a large following of admiring fans. Persons following a particular team are often highly biased against opposing teams in the league and often closely identify with the team of their choice. In an attempt to enable fans to show identification with a particular team, the leagues make available a large assortment of sales products containing indicia representing the individual teams. As each team has a specific logo and color scheme, the products representing the different teams are often made separately which necessitates large manufacturing costs and time expenditures. Also, while the sales products identify particular teams, they do not provide a product which allows a purchaser to feel specifically associated or identified with a particular team within the organization.

Further, there is typically one or more individuals on a team which are the favorite of fans who identify with the team. For children, the favorite players often represent role models which children aspire to be like, especially with respect to performance in a particular sport.

SUMMARY OF THE INVENTION

The present invention provides a method which achieves an efficient and less expensive way for organizations or teams within a common association or league to be separately identified in a publication. The present invention also provides a method in which fans can closely identify themselves with a team of their choice and even a particular member of a team of their choice. The present invention, through its use of team association and story line, provides a publication which is exciting to read, fun and educational. The story line can be personalized and written so as to build feelings of confidence and self esteem in a child by having the child achieve an important goal such as hitting a game winning home run or the winning basket at the buzzer.

In so doing, the present invention features a method for making a publication or other tangible medium of expression that differentiates in an enhancement stage one or more particular organizations (e.g., teams) which are members of a common association (e.g., a sports league). The method includes generating a graphic indicia image that is generic with respect to each of the organizations and pertains to the association. The method also includes enhancing the generic graphic indicia by applying additional indicia to the generic graphic indicia so as to convert the generic graphic indicia to depictions which depict a particular one of the organizations in the association. The method further includes forming a plurality of pages which include the enhanced generic graphic indicia. The forming of a plurality of pages also can include generating a first type of text that is generic with respect to the different organizations and forms part of the generic graphic indicia, a second type of text which is particular to one or two of the organizations and forms part of the enhancement indicia and a third type of text which pertains to the intended viewer.

Also, the invention includes providing means for identifying or associating a subject significant to a reader of the publication (and preferably free from association with the association) with the organization or a member of the organization. The identifying means includes strategic positioning of cut-outs with respect to the facial area of a depiction of a representative or member of the organization and providing a pictorial representation positioning means for assuring proper placement of the pictorial representation with respect to the facial cut-outs.

The present invention further comprises personalizing the publication through the placement of a pictorial representation in the positioning means. Personalizing the page sets also includes providing blank spaces within the generic text printed out in the printing stage. The blank spaces are arranged and sized for insertion of the subject's name therein such that an incomplete sentence is completed. The personalizing of the publication preferably includes positioning a pictorial representation (e.g., photograph) on a page of the publication such as the last page or the interior surface of a hard cover. The cut-outs are formed so as to be aligned in the intermediate pages and in the front cover so that the face in the pictorial representation is visible through the front surface of each of the intermediate pages and the front cover of the publication.

The generic graphic indicia preferably depicts individuals in a sports league with a generic representation of a uniform that is common to all of the teams or organizations in the league. The generic graphic indicia can also include background indicia that pertains to the sport of the particular sports league being represented.

The generic graphic indicia is preferably either drawn on artwork and scanned to store the artwork in memory or generated on a computer from the outset.

Enhancing the pages includes modifying generic graphic indicia so as to depict at least one representative member of one of the organizations. The pictorial representation positioning means is located so as to position the pictorial representation such that the face in the pictorial representation is aligned with the facial cut-out in the graphic depiction of the organization's representative member. Thus, upon insertion of a pictorial representation of the subject, the subject appears to be the individual that is a member of one of the organizations. For example, the generic graphic indicia can include a generic depiction of a sports player in uniform and the enhancing indicia can include the logo, color scheme, uniform striping and name or number of a particular "real" player on the team or just the color scheme and number of either a particular player or just a fictional player on that particular team. The player depicted by enhanced generic graphic indicia has the cut-out in the facial area and the subject's face on the pictorial representation appears through the aligned cut-outs.

In a preferred embodiment, cut-outs are provided in a plurality of pages such that the face portion of the subject is viewable through a plurality of pages. Text can be provided which corresponds with the enhanced depictions appearing on the pages. Also, to even further personalize the publication, some of the text which is placed on the pages can be with specific reference to the subject; for instance, "the coach looked to [subject's name] to replace the injured player". Blank spaces in the text can be used to allow for the manual insertion of the subject's name by the subject.

Thus, in one embodiment of the invention, the step of placing graphic indicia on individual pages includes providing characterizations of a team member or a plurality of team members with generic representations of each member's team uniform, and wherein enhancing at least some of the pages includes providing color to the team uniforms and additional indicia which is characteristic of a particular team within the sport association. Also, the step of identifying a subject with a member on a particular team of choice includes providing a cut-out in each page of the publication which is aligned with the pictorial representation positioning means in which the pictorial representation is to be provided. The single, representative member of the particular organization is shown in a plurality of different pages in different settings and activities. The depiction of the representative member is arranged in each page image so that the cut-out is aligned with an adjacent page and with the pictorial representation positioning means. Thus, it appears that the subject is carrying out the different activities being carried out by the representative member of the team in each setting provided on a page of the publication.

The invention also contemplates providing a plurality of positioning means for receiving a plurality of pictorial representations. Also, a plurality of cut-outs are provided on each page to correspond with the plurality of pictorial representations. This arrangement allows for the facial area of a plurality of non-member subjects to appear as particular members of a sports team due to the facial area of the non-members being aligned with the cut-out facial areas of a plurality of member illustrations.

The method of the invention also includes enhancing the same generic graphic indicia with different enhancement features to convert the generic graphic indicia so as to depict a different one or more of the organizations or teams within the same association or league. The present invention makes it possible to enhance pages so as to illustrate two different organizations on the same page or within the same page set. For example, two different rival sports teams can be shown in competition. The individual teams are shown separately based on their associated color scheme, uniform striping, logos, etc. The generic graphic indicia would include, in this situation, a generic depiction of two teams in competition and thus the enhancing step would be conducted with the same steps for each team but different color schemes, logos, etc. would be provided for the members on the different teams. In this way, the local favorite team can be shown in competition with the main rival of the favorite team. Different teams can also be represented alone on a plurality of respective pages in the publication.

The generic graphic indicia can be in the form of action scenes wherein the silhouette of a plurality of individuals are shown. The action scenes can be extended for two adjacent pages within the page sets.

The step of enhancing can also feature providing sufficient detail (e.g., name, team number, etc.) to a generic representation of an individual to designate a particular individual which is a member of the organization and is familiar to the viewer. For example, a famous basketball player's name and team characteristics can be added in the enhancement step. Thus, when the subject's face is aligned with the cut-out, the subject appears as though he is the famous player.

The fixed text (i.e., text that is non-variable from page set to page set) is preferably provided to the pages at the time of applying the generic graphic indicia but could be applied at a later stage (e.g., at the same time the generic graphic indicia is being enhanced). The fixed text can also be provided with the generic graphic indicia and scanned along with the generic graphic indicia. Variable text, such as text which changes from set to set and which can include personal information about either an individual associated with the team (e.g., stats for a particular sports player), the team's name or, personalized data which is significant to a subject not associated with the association (e.g., the name of the purchaser's child), can be added to the page set. The personalized data can also be provided manually by the recipient after purchase. Alternatively, the personalized data can be provided at the point of manufacture through oral or written information provided by the intended recipient.

When the variable text involves a particular member of the team, it is possible in the present invention to place a pictorial representation of that player (as opposed to the subject's picture) in a pictorial representation storage location such that the representation is aligned with cut-outs which correspond with the facial area of an enhanced generic representation of that team player. More preferably, however, a facial representation of someone significant to the viewer (e.g., the viewer's own face) and not associated with any of the organizations is positioned within or on a pictorial representation positioning means for proper placement of the picture. The positioning means is preferably located on a support member such as an extra page in the page set. The positioning means can include a pocket storage member with transparent cover for protection of the picture or added indicia to designate the proper location of the picture. The added indicia can also include information concerning the association or league.

The above described method of the present invention also provides for a unique publication which comprises a plurality of sheets, with at least some of the sheets including graphic indicia generically depicting individuals which are members of an association comprised of a plurality of organizations. At least some of the sheets further comprise enhancing indicia which includes coloring and logos for depicting the individuals as members of a particular one of the organizations in the association. The individuals include facial areas and a plurality of the sheets have a common individual depicted in each. The facial area of the common individual has an aperture Or cut-out formed therein which is preferably aligned on at least some of the sheets in which the common individual is depicted. There is also provided a pictorial representation positioning means for helping to properly position a pictorial representation of a subject which is free from association with the association or a particular member of the association. The pictorial facial representation is positioned on the publication at the positioning means location so as to be visible through the cut-out formed in each of the depictions of the common individual. Also provided as part of the publication is text which relates to the individual depictions and spaces strategically positioned for the insertion of personalized text which is in personal reference to the non-member subject being represented as a member of the organization or team of a particular association or league.

BRIEF DESCRIPTION OF THE PREFERRED EMBODIMENTS

The present invention will be more fully understood from the detailed description given herein below and the accompanying drawings which are given by way of illustration only, and thus are not limitative of the present invention and wherein:

FIG. 1 illustrates, in perspective, one embodiment of a publication formed in accordance with the method of the present invention;

FIG. 2 provides an elevational view of the cover of another embodiment formed in accordance with the method of the present invention;

DETAILED DESCRIPTION OF THE PREFERRED EMBODIMENTS

Figure 1:
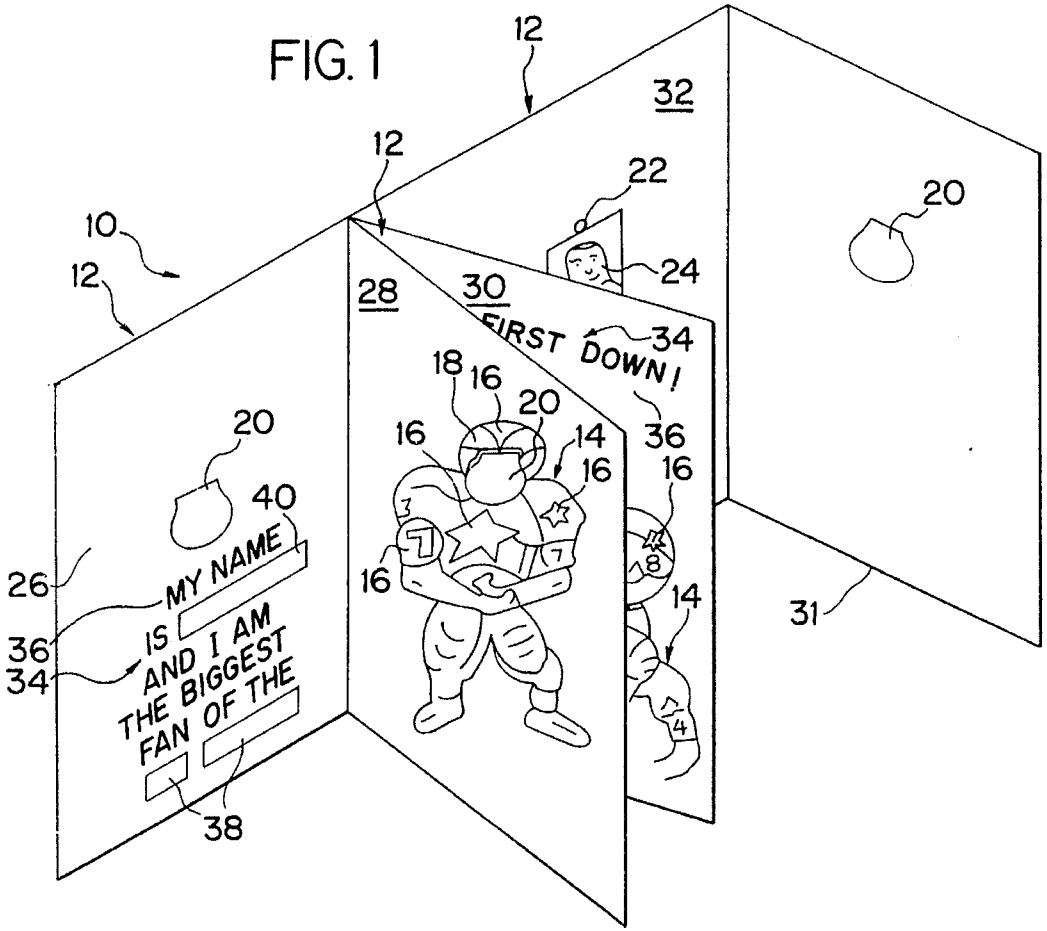

FIG. 1 of the present invention illustrates, in perspective, one embodiment of a completed publication 10 formed in accordance with the method of the present invention. Publication 10 is shown to comprise a page set 12 which includes front cover page 26, intermediate pages 28 and 30, back cover page 32 and gate fold 31. The front and back cover pages can be formed of the same material as the intermediate pages or, more preferably, of a more durable material such as a wipeable plastic or of a thicker paper material (hard cover material). The cover pages and intermediate pages can be joined in any one of the methods commonly known in the art (e.g., staples or adhesive along a back binder) or placed in loose leaf fashion within a continuous sheet folded to represent the back, front cover and gate fold. Also, although only a few intermediate pages have been shown, any desired number of intermediate pages can be used.

Intermediate pages 28 and 30, gate fold 31, and front cover 26 are each formed with at least one cut-out 20 which is positioned essentially at the same location on each of the pages so as to be in alignment.

FIG. 1 also illustrates generic graphic indicia 14 outlining an individual wearing a football uniform. The generic graphic indicia 14 is shown in FIG. 1 to have been subjected to an enhancement method step which includes the addition of added indicia 16 which can take any form which will depict and distinguish one organization in an association from the remaining organizations in the association. For example, indicia that would be capable of converting a generic depiction of an individual in a professional sports league to a depiction of an individual belonging to a particular team in that league would be suitable. The added indicia 16 can thus include a particular color scheme, team logos, striping, numbers, etc. FIG. 1 illustrates added indicia 16 in the form of a team's logo on the helmet 18 and jersey of a football player as well as numbers on the jersey of the football player. The other intermediate page 30 also features enhanced generic representations of players in action (partially shown). The numbers on the jersey can also be provided as part of the generic graphic indicia, and an enhancement step provides the appropriate color to the interior of the number while the surrounding jersey or helmet is usually enhanced in a different color.

FIG. 1 further illustrates picture positioning means 22 provided on the interior face of back cover page 32 positioning means 22 can take the form as a holder supported by a support member such as one of the pages in the page set. The holder is preferably an adhesive patch provided on the back cover, a pocket with protective plastic cover, or a clip. Alternatively, the positioning means can take the form of added indicia which depicts the proper position for a pictorial representation such as photograph 24. Thus, the positioning means helps ensure that the photograph is in a proper position with respect to the aligned cut-outs. The proper positioning of the photograph results in the facial component of the photograph being aligned with the cut-outs 20 formed in the intermediate pages, front cover page and gate fold 31. FIG. 1 also illustrates the positioning of cut-out 20 in the facial area of the enhanced generic graphic representation of a football player. Cut-out 20 is actually configured to correspond with the open facial area of helmet 18.

On the interior of cover page 26 and on the front face of page 30 there is provided text 34 which preferably forms part of a storyline extending throughout the publication 10. Text 34 is shown in FIG. 1 to comprise non-variable text portion 36 (i.e., text which is generic to each organization in the association and text which does not include data pertaining to a particular organization or personalized data concerning the intended viewer of the publication). Text 34 also includes variable text portion 38 which relates specifically to an organization within the association and will vary in accordance with what team is or teams are represented in the enhancement step. Reference number 38, for instance, could be the team name "La Stars" (fictitious) to name the particular organization represented by the team logo and color scheme provided by added indicia 16. Text portion 40 (shown schematically) represents a location left bank for the insertion of personalized text which features personal characteristics of the intended viewer ("John") of the publication. The generic text does not present a complete sentence or thought until the insertion of the text pertaining to a particular organization or personalized text in the blank left for such an insertion. The insertion of the personalized text can be done manually by the purchaser or done as a manufacturing step simultaneously or separately with respect to providing the other non-generic information. For example, the intended purchaser can indicate either orally or in writing the name of the ultimate recipient so that the name can be inserted prior to providing the purchaser with the publication.

Figure 2:
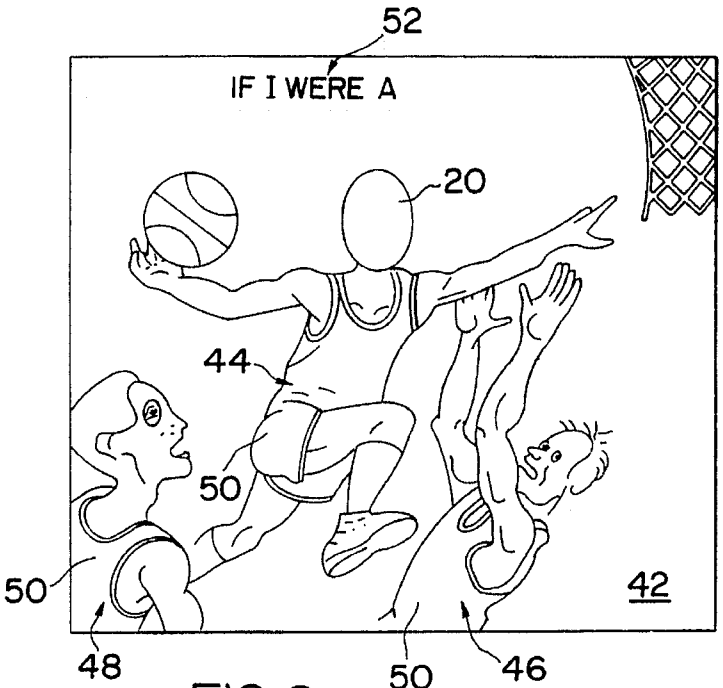

FIG. 2 illustrates cover page 42 of an alternate embodiment of the invention which features generic graphic indicia showing generic depictions of basketball players prior to the step of enhancement with added indicia to depict one or more particular basketball teams within a basketball league or association. As shown in FIG. 2, players 44, 46 and 48 each are shown wearing a generic representation of a basketball uniform 50. Cover page 42 also includes cut-out 20 formed in the facial area of player 44. As in the previous embodiment, cut-out 20 in cover page 42 would be aligned with a pictorial representation positioning means such that the facial area of a mounted pictorial representation at the back of the publication (for which page 42 forms the cover) would be viewable when the cover page is closed. Cover page 42 also includes generic or non-variable text portion 52 which is to be completed or supplemented in an enhancement step described in greater detail below.

Figure 3B:
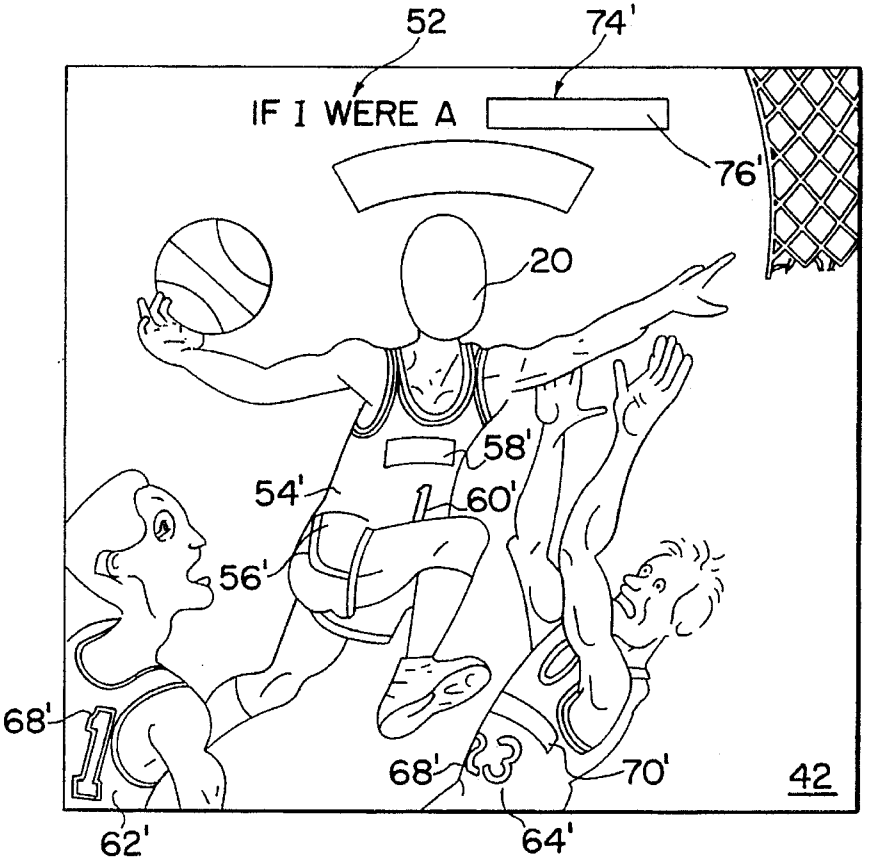
FIG. 3B illustrates a second embodiment following enhancement of the generic graphic indicia contained in FIG. 2.
Figure 3A:
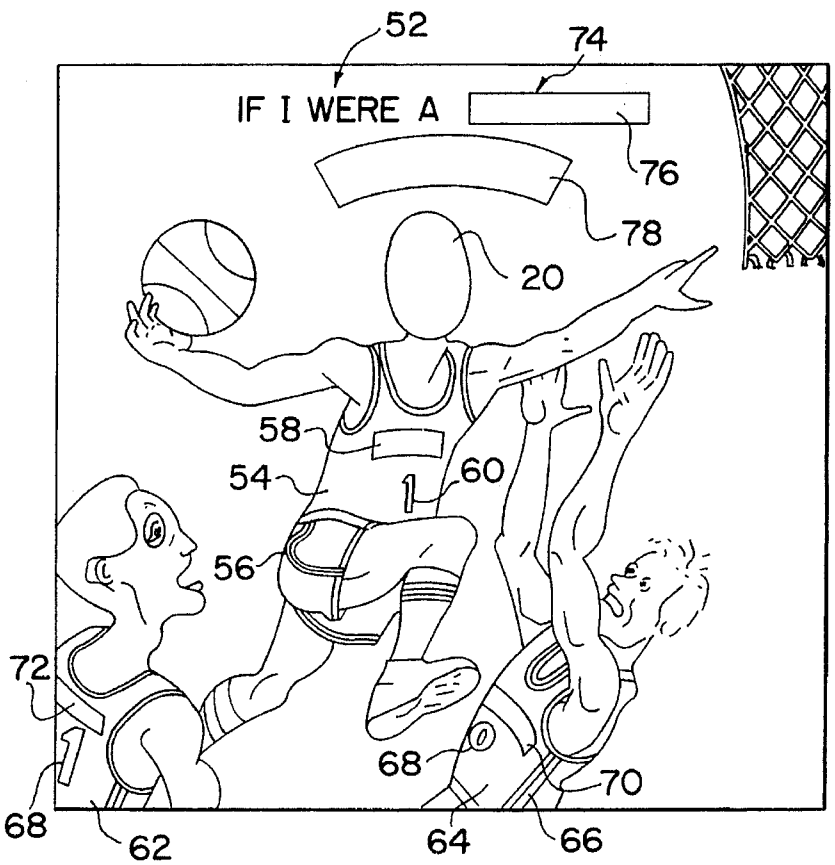
FIG. 3A illustrates one embodiment following enhancement of the generic graphic indicia contained in FIG. 2.

FIG. 3A of the present invention shows the generic depiction of FIG. 2 following the method step of adding indicia which converts a generic depiction of an individual to at least one individual associated with a particular team in the league. Thus, in FIG. 3A, the generic uniform 50 of player 44 has been enhanced so as to represent a uniform 54 of a particular team. In the embodiment shown in FIG. 3A, uniform 54 has been enhanced so as to include the color scheme (e.g. green background/white lettering), uniform striping 56 and a team name represented schematically at 58 (e.g., "Boston Vikings" basketball team).

FIG. 3A also illustrates that the non-variable text portion 52 which, in the particular embodiment shown in FIG. 2, read "IF I WERE A" has been enhanced with variable text 74 to include the city designation 76 (e.g., "Boston") and schematically represented name 78 (e.g., "Vikings") of a preferred team of the intended viewer of the publication. In addition to the team logo, the generic uniform 50 of FIG. 2 has also been enhanced by the addition of a number "1" or at least interior coloring for a preexisting number outline in the generic graphic indicia (referenced by reference number 60). The addition of a number provides a way for depicting a particular player within the organization that is the favorite of the intended viewer.

FIG. 3A also illustrates the addition of added indicia to convert the generic depiction of uniformed players 46 and 48 into members of a different team in the league which is preferably a main rival to the preferred team. FIG. 3A shows the conversion of generic players 46 and 48 in FIG. 2 to member players 62,64 of a particular opposition team through the placement of added indicia such as that represented schematically as 70 which could be, for example, the name of the rival team (e.g., the "Los Angeles Stars") , team uniform markings 66 and the team's color scheme (not shown). The addition of enhancement indicia such as a player's name shown schematically at 72 not only identifies specific opposition team players but also helps in defining the team itself. The opposition team members are also shown in FIG. 3A to have jersey numbering 68. Although not shown for this particular embodiment similar enhancement steps would be taken to convert other generic representations appearing on the other pages in the publication for which the cover page in FIG. 3A forms the cover. A story line could thus be provided with respect to the basketball embodiment shown in FIG. 3A in a manner similar to that which was previously discussed for the football embodiment of FIG. 1.

In addition to the generic graphic representations described above, the present invention also contemplates providing background indicia such as the fans depicted in FIG. 10. Coloring to this background indicia can be provided together with the enhancement of the team players. For example, the basketball shown in FIGS. 2 and 3A can be colored orange in a step contemporaneously or simultaneously with the above-described enhancement step wherein, preferably, a particular team or teams' color scheme is added to the generic representation of a player.

FIG. 3B shows another embodiment following the addition of enhancement indicia to the generic uniform depictions in FIG. 2. In FIG. 3B the features which are similar to those in FIG. 3A have been designated with the same number only dashed. A comparison of FIGS. 3A and 3B reveals the depiction of two different sets of rival teams in competition with both stemming from the same graphic indicia. In FIG. 3A the rival teams were described as being the "Boston Vikings" and the "Los Angeles Stars" while FIG. 3B represents the Cleveland "Chargers" (Charges being schematically represented at 53') in competition with the Chicago "Bison"(Bison being schematically represented at 70') with all four teams being organizations within a national or international sports association. Thus, the generic images can be easily converted to different teams within a particular league while the fixed storyline, background, generic uniform and player depictions are the same for each publication despite the variable enhancement possibilities.

Figure 4:
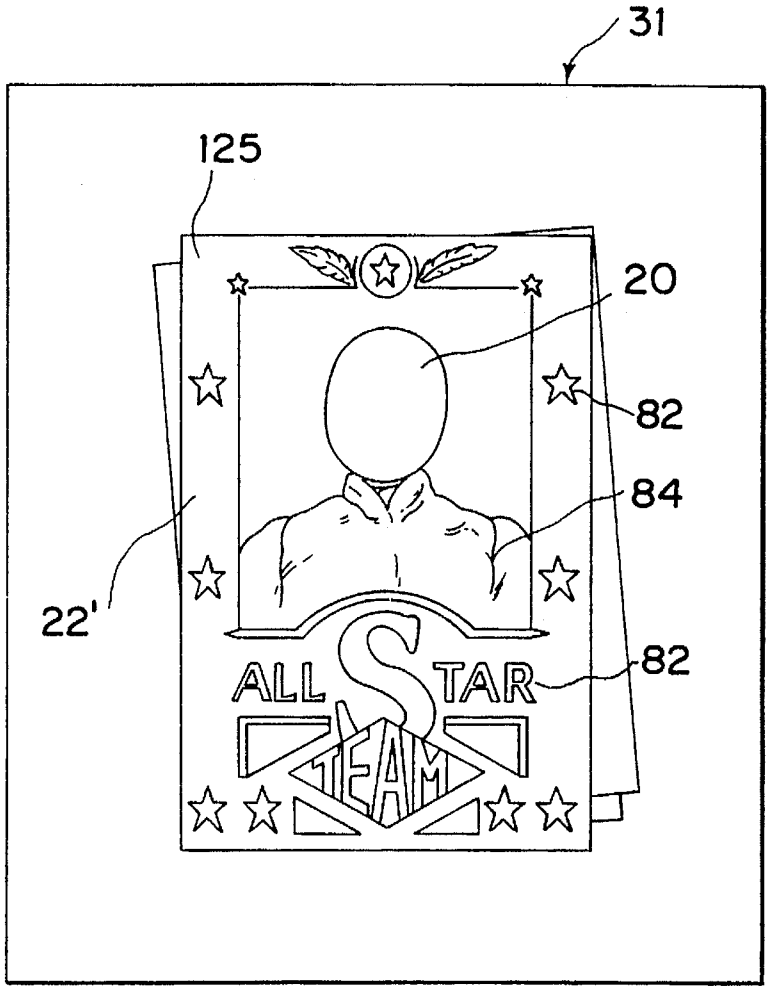
FIG. 4 illustrates positioning means which includes a sports card which is intended to extend about the pictorial representation.

FIG. 4 depicts in greater detail a sports card 125 which would appear on the back of gate fold cover 31 of a publication formed in accordance with the present invention (sports card 125 can be on the face of gate fold cover 31 which is not shown in FIG.1. FIG. 4 shows cut out 20 formed in generic indicia 82 (text and graphics) in sports card 125 which, in this embodiment, is for a baseball person 84. Cut-out 20 is positioned such that the placement of the facial area of a pictorial representation of someone significant to the intended viewer (e.g., a picture of the intended viewer) on to the front surface of the back cover results in the subject being viewable through the sports card. Rather than the use of a gate-fold, the present invention also features an embodiment wherein the sports card provides the positioning means. For this embodiment, the indicia for the sports card is formed on the inner face of the rear cover or an intermediate page and the bordering edge of the sports card and/or centered figure is used to help position the pictorial representation in the proper location.

Figure 5:
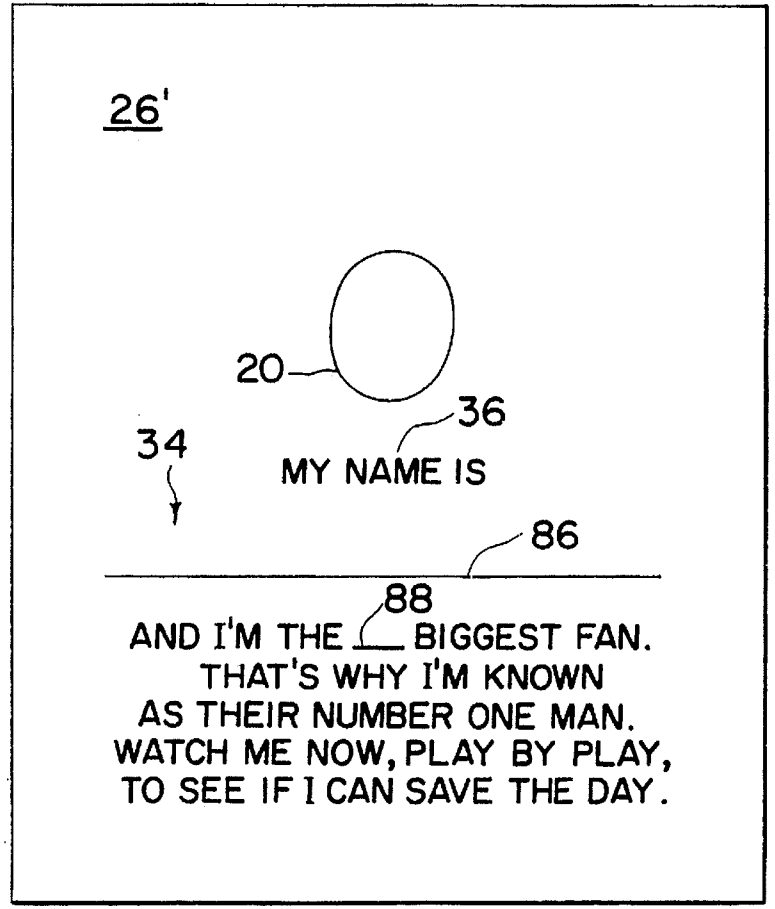
FIG. 5 illustrates one of the first pages of text with generic, non-variable text placed thereon.

FIG. 5 shows the inside surface of a front cover page 26' similar to cover page 26 shown in FIG. 1 prior to enhancement. As shown in FIG. 5, cut-out 20 is formed in the cover page 26' and text 34 is placed on the interior surface of the cover page prior to the step of enhancement, there exists non-variable text 36 as well as a line 86 for insertion of personal characterization data or identifying means such as the intended viewers name. Also, FIG. 5 shows that prior to enhancement a blank space or line 88 is provided to provide room for the addition of the name of a preferred team of the intended viewer. The personal data and team indication can be inputted manually by the viewer or in an automated process prior to receipt by the intended viewer.

Figure 7:
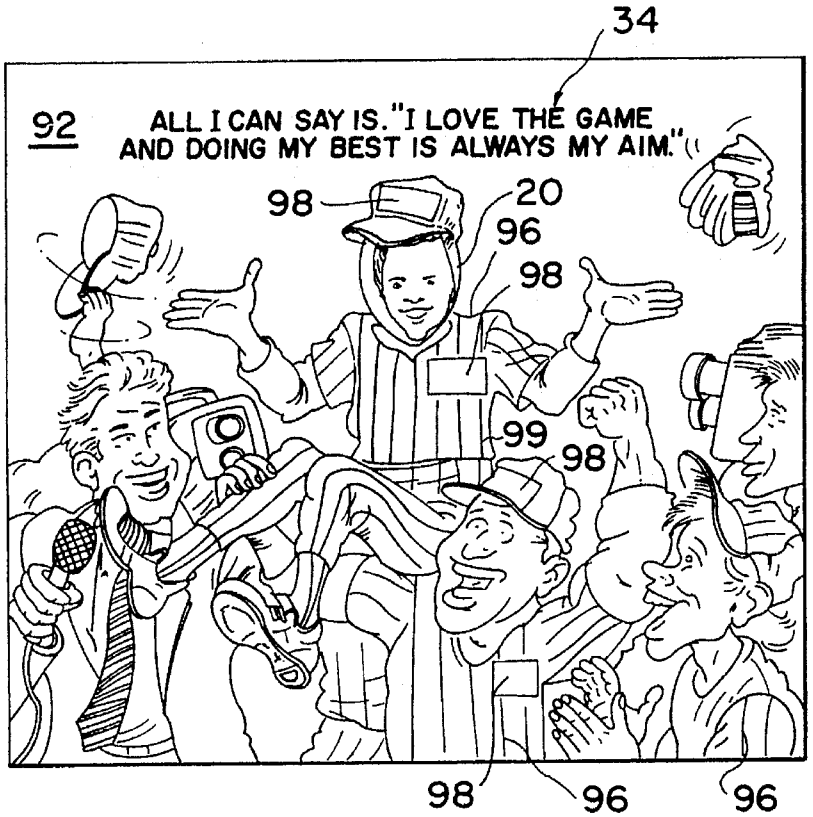
FIG. 7 illustrates the front face of a subsequent page in the same publication containing the page shown in FIG. 6.
Figure 6:
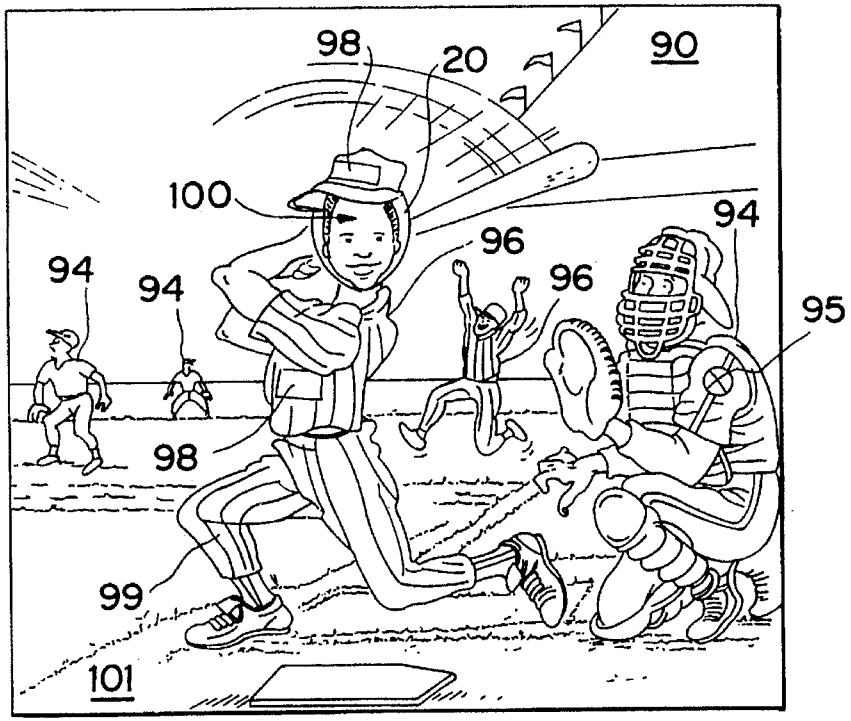
FIG. 6 illustrates a front face of one page of the publication with a pictorial representation visible through a cut out formed therein.

FIGS. 6 and 7 illustrate sequential front faces of intermediate pages 90 and 92 to be placed in a page set like that described for FIG. 1. FIGS. 6 and 7 also illustrate how the facial portion 100 of a picture placed on a back page support (like that illustrated in FIG. 4) appears in alignment through numerous cutouts. Also FIGS. 6 and 7 show how the cut-out 20 is formed in the facial area with respect to a particular enhanced graphic representation of a baseball player on the preferred team players 94 which are shown as being on an opposition team through the addition of enhancement indicia such as uniform indicia 95 are depicted in active competition with members 96 on the preferred team which is depicted with added indicia such as a team logo 98 (e.g., "NJ") and pin striping 99. FIG. 7 also illustrates text 34 being entirely non-variable for that particular page. Although not shown, background 101 can be colored during enhancement (e.g. grass green, base running paths brown, etc.) can be colored as such coloring would be the same for each publication related to the league, despite the insertion of different teams in the publications.

Figure 8:
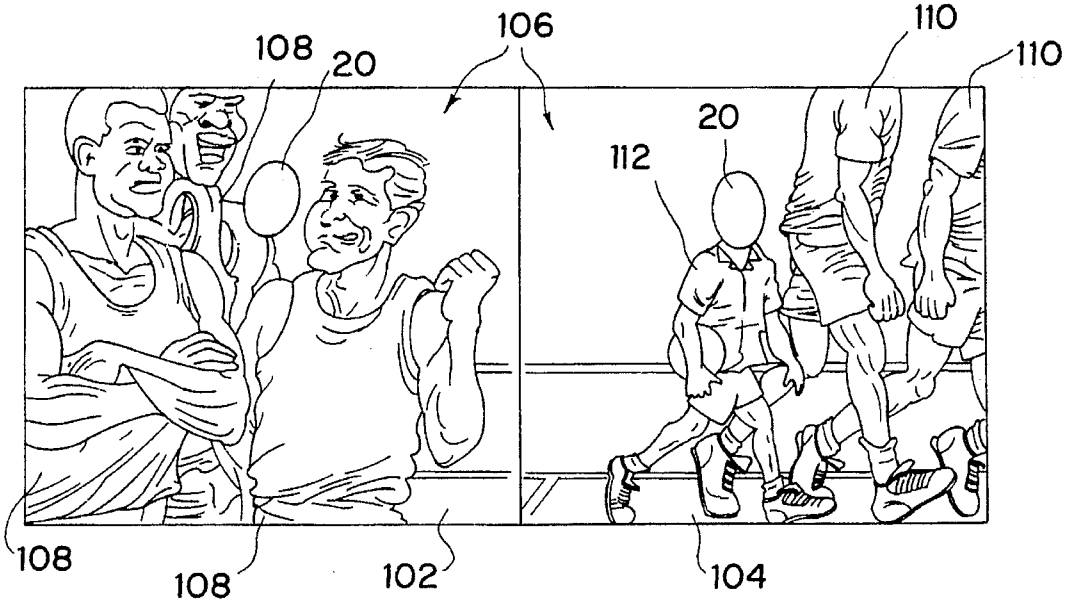
FIG. 8 shows a rear face of a first page of a publication formed in accordance with the present invention and a front face of a page immediately following.

FIG. 8 of the present invention illustrates a rear face 102 and a front face 104 of the next sequential intermediate page which are to form part of a page set for a publication. FIG. 8 shows generic graphic representations of basketball players with the graphic representations being essentially uninterrupted across rear face 102 and front face 104. FIG. 8 additionally shows a grouping of players 108 that will eventually be enhanced to depict the opposition players. FIG. 8 also shows generic representations which will eventually be enhanced to show members of the team preferred by the intended viewer. Unlike the previous embodiments, however, rather than depicting a generic representation of an individual with facial cut-out as having a body configuration of one of the team players, FIG. 8 shows a graphic representation of player 112 with facial area cut-out and of a size conforming closer to the intended viewer than to a typical team player. This enhances the ability of the viewer to feel associated with the preferred team. Cut-out 20 on page 102 is not positioned in the facial area of a player as it would be on the front face of page 102 (not shown). The cut-out positioned on the rear faces of the pages or not in the facial area of a player is positioned in a neutral location with respect to the player members shown on the rear face of the pages. In the context of the present application, "neutral" in general terms means in a location on the page which will not appreciably detract from the storyline. Thus, the cut-out on these pages is preferably provided at a location in the background or if it does the cut-out's area is in the player's depiction (e.g., less contact one of the player members, only a minor portion of than 25% of the cut-out's area).

Figure 9:
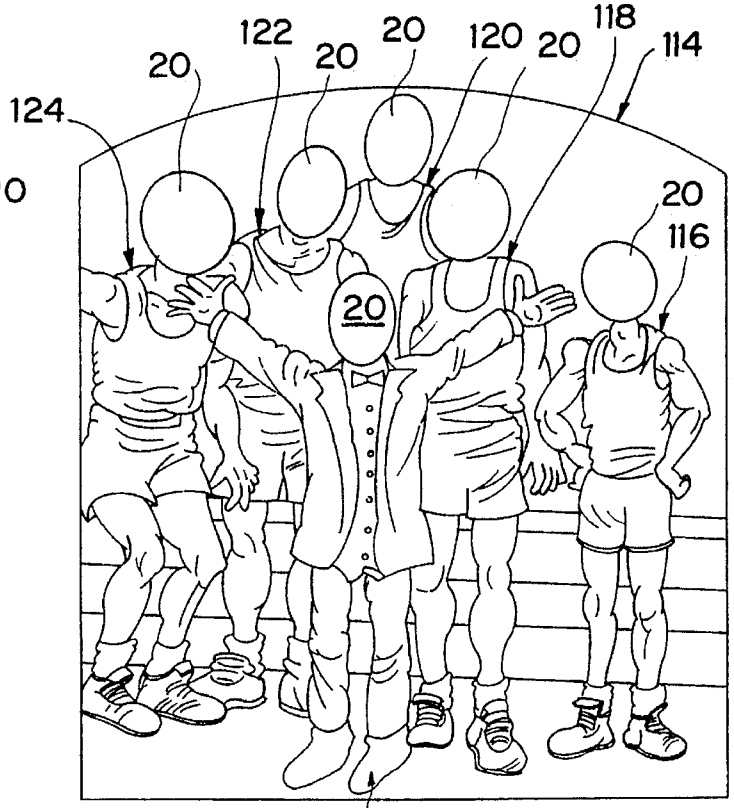
FIG. 9 shows generic graphic indicia of a sports team with coach and each player having a facial cut-out.

FIG. 9 shows another embodiment of an intermediate page with generic graphic indicia 114 showing basketball team players 116, 118, 120, 122 and 124 together as well as a generic graphic depiction 126 of a coach. The generic graphic depictions 116, 118, 120, 122, 124 and 126 each include a facial cut-out 20. In this alternate embodiment of the invention, a plurality of pictorial representations (such as those of a lower grade school team) can be inserted so as to be visible at least in the one generic representation.

The method of the present invention includes assembling a plurality of page sets with at least some of the pages in each page set having generic graphic indicia placed thereon. The generic graphic indicia depicts in generic fashion individuals of a particular association and, preferably also includes some background or environment depictions which corresponds with the activity of the association. Each page set is assembled so as to have the same generic graphic indicia.

The initial placement of the generic graphic indicia on the pages of the publication can be achieved in any of the known methods known in the art. For example, the generic graphic indicia (which can include generic background indicia) can be computed in four color art and scanned into a computer color separator to create a "master" publication data base which can be immediately placed in hard copy or transferred by data storage means to a separate location where enhancement is to take place.

The placement of the generic graphic indicia on a plurality of the page sets is done such that areas are left for the insertion of the added enhancement indicia. For example, in the embodiment shown in FIG. 2 the uniforms of the players are left blank for the insertion of the teams color scheme, striping, logo etc. as represented by FIGS. 3A, 3B.

The non-variable text is preferably applied prior to the enhancement step (e.g. during, immediately before or immediately after the placing of the generic graphic indicia). The insertion of the text can be achieved through the use of a computer, printer and appropriate software, a scanner and a printer or in any of the other known methods for applying text to page sheets.

The generic graphic indicia is then further enhanced in an enhancement step wherein the blank areas remaining in the generic representations are filled in to convert the generic graphic representation to a representation readily identifiable with a particular organization (or team) in the association (or league).

The enhancement step can be carried out through the use of any sophisticated printer using existing software. In one embodiment of the invention, the enhancement step involves placing an overlay that indicates the proper placement of the added indicia. Color codes can be provided in appropriate areas within the generic graphic indicia during a computer scanning process wherein the data for a particular master publication is stored in the memory of a computer. The color codes would trigger a printer in communication with a computer storing the information obtained by scanning to apply the appropriate color within the generic graphic indicia to achieve the conversion of the generic representation to one readily associated with a particular one of the organizations in the association of organizations.

The method of the present invention also features the formation and use of a plurality of the aforementioned overlays for application over various master publications. The overlays facilitate the conversion of a generic graphic representation to one depicting a particular organization. The overlays are preferably cataloged or stored by memory means in a library format for easy access. For instance, generic storyline and graphics for use with various associations or leagues (e.g., NBA, NFL, etc.) can first be categorized together, with each category being broken down into sets for each particular team within a league. An overlay or group of overlays corresponding with each team within a particular league would then be categorized in relation to the particular team or teams which are to appear following enhancement.

The present invention thus provides for the forwarding of the appropriate overlay together with the "master" publication material (e.g. tangible copies or stored data) to publishers or printers to, for example, the locale of a preferred team such that team specific final publications can be completed with relative ease and little expense. Further, the local publisher or printer can easily input the variable text concerning the local team (with known inputting techniques such as those relying on a computer, printer and software) and also provide the personal data based on information provided by an intended purchaser (using known software and the same equipment described above). The publication process can also be carried out at a central location with completed publications being sent out to distributors throughout the sales region.

Figure 10A:
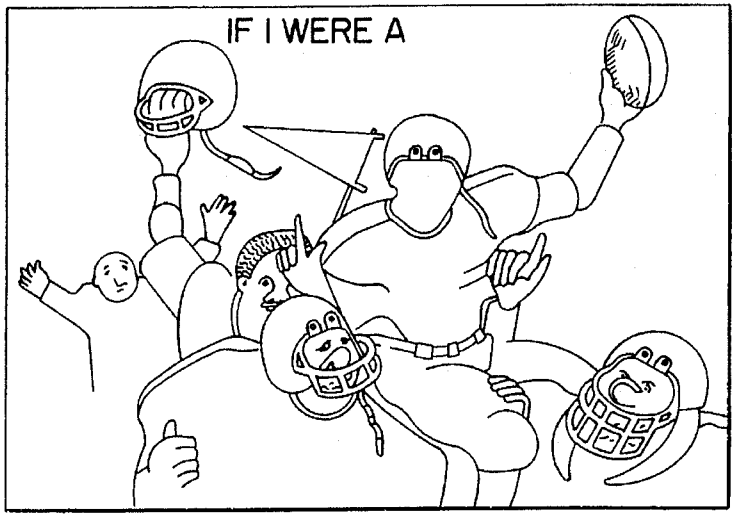
FIGS. 10A–10D illustrate the steps involved for enhancing originally generic graphic indicia in one embodiment of the invention.
Figure 10B:
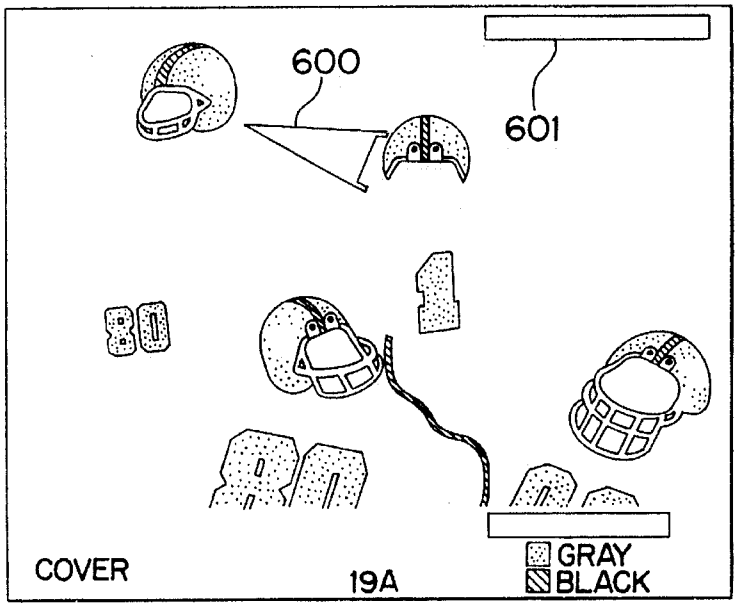
Figure 10C:
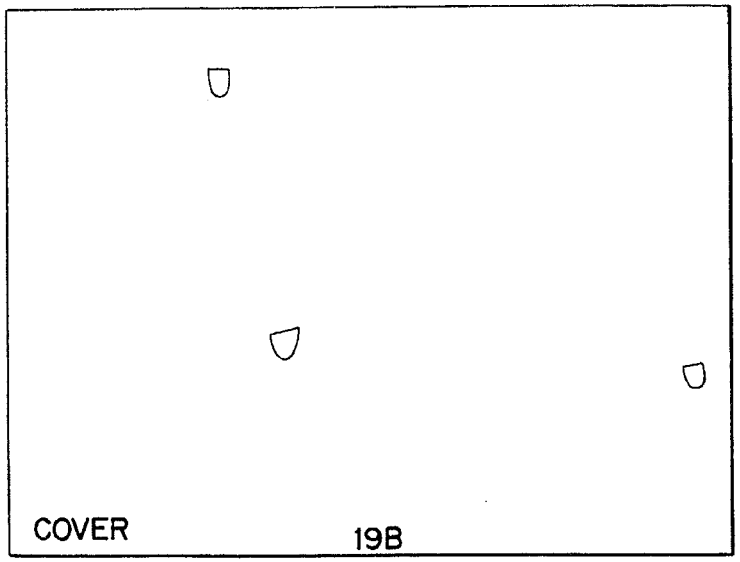
Figure 10D:
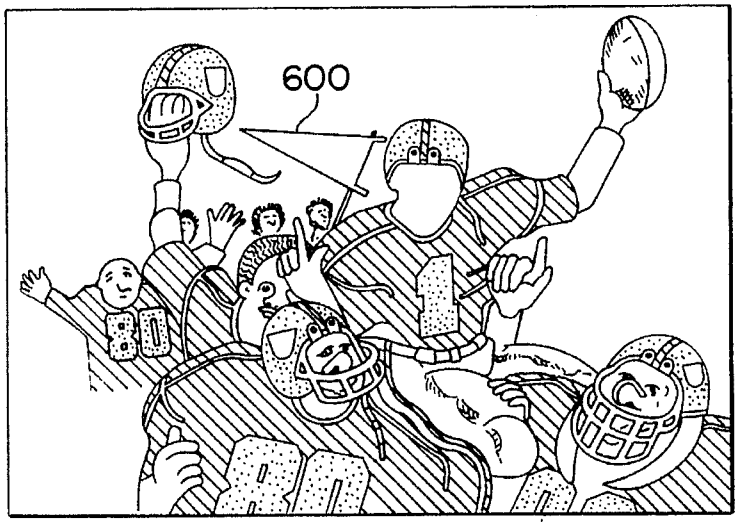

FIGS. 10A–10Dillustrate the use of overlays in the enhancement of generic graphic indicia. FIG. 10A illustrates a sheet containing generic graphic indicia to appear on the cover of a publication. FIG. 10B illustrates a first overlay designated for use with the sheet and which is also designed for use in a publication involving the Los Angeles Raiders football team in competition with the San Francisco 49'ers. In the overlay of FIG. 10B the schematic box 600 designates, for example, the phrase "Raiders" and box 601 "Los Angeles Raiders". FIG. 10B shows one overlay sheet for the insertion of particular enhancement indicia which in this case involves the team name, team striping and jersey numbering. FIG. 10B also shows enhancement through use of certain colors (silver and black). FIG. 10C features particular team logos, which are to be used in association (e.g. sequentially) with the overlay of 10B to provide the generic uniform depictions with the team logos. FIG. 10C also shows the use of operator instructors to facilitate the enhancement process. Numerals "19A" and "19B" provide reference to a particular set of overlay sheets, while "cover" determines" the appropriate page being enhanced and alignment marks (not shown) help in aligning the overlays with respect to the generic graphic indicia sheet. In FIG. 10C, the shield configurations represent logos for the LA Raiders team (i.e., the familiar helmeted head with eye patch the having crossing swords in the background). FIG. 10D illustrates a publication following completion of the enhancement steps. FIG. 10D also illustrates the completion of the color scheme (gray and black) for the uniforms. The sequence of overlays and coloring would depend upon the software being utilized in the enhancement process. Color separations involved in the enhancement of the generic graphic indicia can be done on a "SCITEX" color separator available from Screen (Midwest) company located in Rolling Meadows, Ill.

Another method of the present invention includes generating image data representative of the generic graphic indicia. In this method as well, the generic graphic indicia depicts, in generic fashion, individuals of a particular association and preferably also includes some background or environment depictions which correspond with the activity of the association.

With this method, particular features of the generic graphic indicia are enhanced, so that the graphic indicia is identified with individuals within a particular organization (e.g., team) of an association (e.g., league). The features to be enhanced are selected, and image data corresponding to these particular features are distinguished from the image data representative of the generic graphic indicia as a whole. The feature data for the distinguished particular features is then enhanced, so that the particular features represented by the feature image data will be associated with one or more individuals of a particular organization within the association. Because the image data for these particular features is distinguished from the other image data, this feature data can be modified without changing the other image data (e.g., data pertaining to the background and generic uniform depiction). A particular application of this method will be discussed in more detail with reference to the flowchart shown in FIG. 11.

Figure 11:
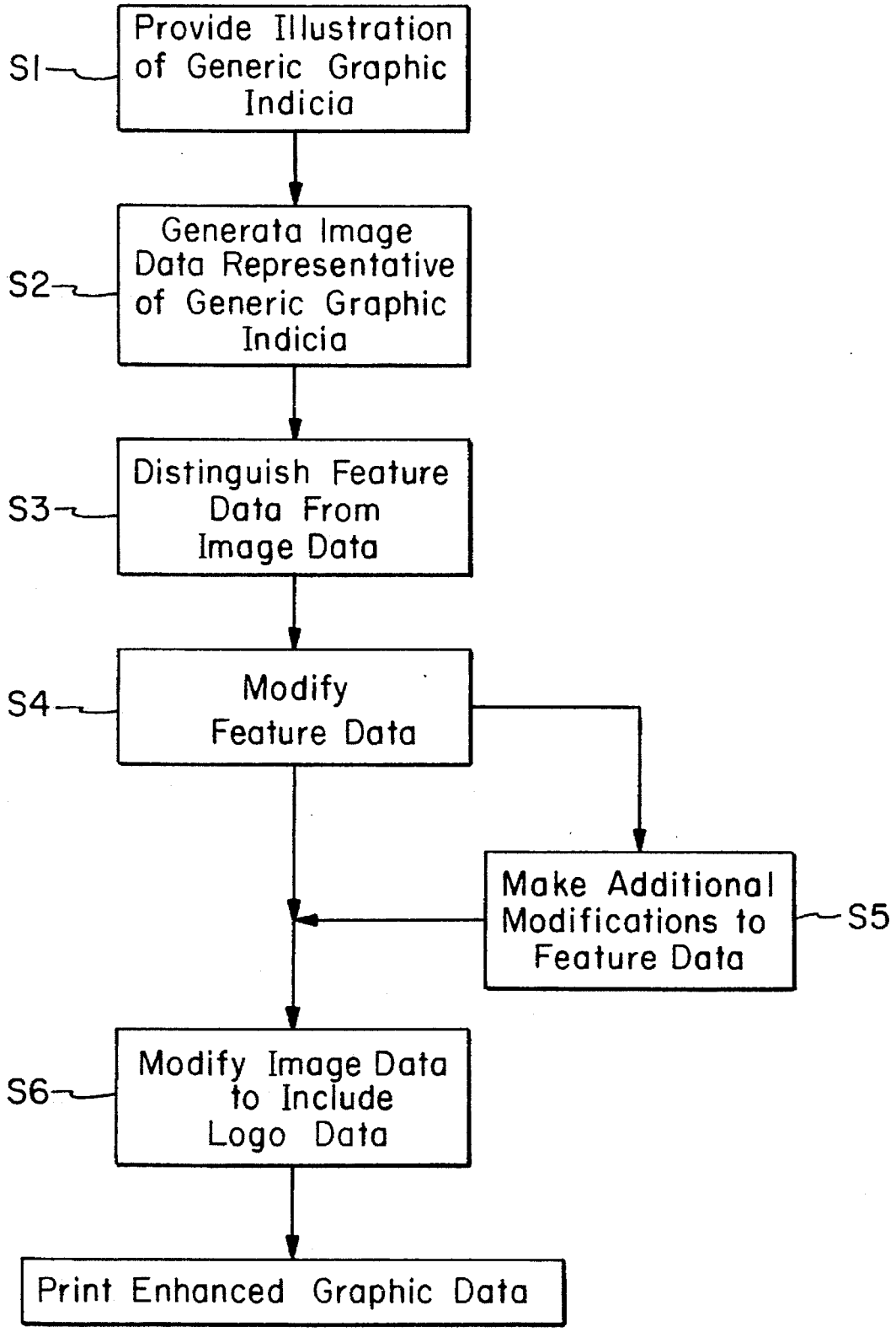
FIG. 11 shows a flowchart of the alternate method of forming a publication under the present invention.

An illustration of the generic graphic indicia, including those features which are going to be enhanced is drawn or otherwise provided on an illustration board, or the like in step S1 shown in FIG. 11. For example, the illustration board can depict a generic image with football players of two opposing teams. In this illustration, features of the image, such as uniform pants, shirts, helmets and shirt numbers are generic and do not correspond with a particular team or organization, but do correspond with or relate to the league or association (e.g., the generic team uniforms and background relate to the NFL).

The illustration board is then scanned to generate image data representative of the generic image on the illustration board in step S2. Alternatively, the generic image can be originally developed on the computer screen in generating step S2. In this case, the step of providing an illustration board S1 is omitted, and the generic image is generated on the screen and stored in memory. Once the image data is generated, it can be converted to a convenient file format, such as a Macintosh or IBM computer compatible file format. One format that Applicant has found to be convenient in some instances is a Macintosh compatible CMYK (cyan, magenta, yellow, black), T.I.F.F. (Tagged Image File Format), file format. The image data should be stored on a convenient medium, such as optical discs, or magnetic discs. Applicant has found it useful to employ a Sledge Hammer external drive for this purpose.

Once the image data has been generated and, where desired, converted to a convenient format, the image data is altered or enhanced using an appropriate software program. For example, Adobe Photoshop software may be used with a Macintosh Quadra 950 computer to modify the image data.

After generation, the image data should be stored on a convenient medium. Applicant has found it useful to store image data on magnetic optical discs for the purposes of transporting and archiving the data. Alternatively, Applicant has found it useful to store the image data on a Sledge Hammer external drive for this purpose of enhancing the image.

Discussing the enhancement of the image data in more detail, portions of the image data corresponding to particular features of the generic graphic indicia are first distinguished and separated from the overall generic graphic indicia. Subsequently, the distinguished and separated feature data is modified so that the distinguished particular features will be associated with representative members of a particular organization. For example, if the generic graphic indicia is a football scene with individuals from two opposing teams, the image data representing the uniforms of each individual will be distinguished from the data pertaining to the overall generic image. The data for the distinguished feature is then separated and modified to correspond with a particular team or organization within the association or league.

Step S3 is representative of the distinguishing step wherein those features of the generic graphic indicia which are to be enhanced and the corresponding portion of the image data (hereafter referred to as "feature data") are selected and distinguished from the image data as a whole. When using the Adobe Photoshop software, the features are shown on a display, and the features which are to be modified can be outlined. This may be done with conventional means, such as a Wacom tablet and stylus.

Feature data for each outlined feature can then be set aside in a channel (e.g., means for separating and distinguishing data) for that type of feature. Referring again to the example showing opposing football teams, feature data for each of the uniform pants for a particular team can be set aside as a single channel. Similarly, feature data for each uniform shirt (including shirt numbers) and helmet for a particular team can be set aside on respective single channels. Thus, if the football graphic generic indicia showed three players from a single team, there would be 3 separate channels for the depicted members of that particular team. If there were additional players on the opposing team, an additional three channels would need to be set up to represent the 2 uniform pants, uniform shirt and helmet features for the members of the opposing team.

Alternatively, feature data for each feature can be segregated into an individual channel. Thus, for the football graphic indicia which shows three players of one team, there can be nine channels (e.g., one channel for each of the uniform pants, one for each of the uniform shirts, and one for each of the helmets). Similarly, if the football graphic indicia also depicts three players of an opposing team, there could be an additional nine channels for feature data.

Once the feature data is selected and distinguished from the other image data in step S3, the feature data of each channel is then modified, either individually or by groups, as shown in step S4. For example, if the uniform pants for each of two opposing teams had the same color characteristics, then the two channels (or six in the alternate embodiment) set up for each team's uniform pants can be grouped together and simultaneously modified. These modifications are made so that the corresponding features will be associated with individuals of a particular organization. For example, with generic graphic indicia for a football league, the uniform feature data may be changed so that the colors of the uniforms correspond to the colors of particular football team organizations to be represented in what was originally a generic depiction of football players.

The Adobe Photoshop software may be convenient for this purpose, since it supports Pantone Matching System colors. Many popular sports organizations, such as the National Basketball Association (NBA), National Football League (NFL), and Major League Baseball (MLB) teams have uniform color specifications for this system. Thus, for example, if a team such as the N.Y. Giants was to be featured, the group of channels containing the feature data for the pants and helmets can be simultaneously converted to a suitable color for this team (e.g., blue) since the Giants' uniform has the same color for its helmets and shirt. The Adobe Photoshop software is also convenient in that it arranges colors in four color channels (cyan, magenta, yellow and black), obviating the need for color separation if the enhanced image is printed in the conventional four color process.

It should be noted that since the feature data is simply distinguished from the other image data, the feature data can be modified to allow the entire graphic indicia to be associated with a wide variety of organizations without creating, modifying and then combining special data files for each feature. The other image data, such as the image data for the background does not need to be modified. Further, the ability to chose different colors to be associated with the feature data allows for easy conversion when different teams are to be modified. For example, in the above example concerning the blue coloring for the N.Y. Giants, the same feature data for the generic image of the uniform shirts can easily be converted to black which would be suitable for either the L.A. Raiders or New Orleans Saints depending upon what additional colors are provided in the additional modification steps described below for adding uniform and helmet striping, etc. (e.g., black helmet striping for the Raiders versus white and black helmet striping for the Saints).

particular features of the graphic indicia can thus be enhanced by making additional modifications to the image data, as shown in optional step S5. For example, in step S5 the image data can be modified to represent uniform striping associated with a particular organization. This modification can be done with conventional means, such as conventional graphic software.

After the color or other aspects of the feature data have been changed so as to enhance particular features of the generic graphic indicia, the generic graphic indicia may be further enhanced by modifying the image data to include logo data, as shown in step S6. This logo data can be representative of a particular emblem or logo of a particular organization, such as the Raiders' shield described above and/or representation of the league (e.g., the NBA logo or NFL logo). This emblem may be stored in its entirety in a separate data file, and included with the image data when desired. The logo can be made to replace previously enhanced feature data or the logo can be preinserted and a modified distinguishing step can be used to outline around the logo.

When the image data, including the feature data, has been modified to represent the enhancements associating the graphic indicia with individuals of a particular organization, the image data can be used to print or create the enhanced generic graphic indicia in step S7. The enhanced generic graphic indicia thus drawn, can then be arranged in page sets and combined in a book to form the apparatus of the present invention as disclosed in this application. The aligned cutouts in the pages can then be cut with a die cutter or the like after assuring proper alignment with respect to each of the images on the front, rear or both surfaces of the page wherein the subject's face is to appear.

Although the present invention has been described with reference to preferred embodiments, the invention is not limited to the details thereof. Various substitutions and modifications will occur to those of ordinary skill in the art, and all such substitutions and modifications are intended to fall within the spirit and scope of the invention as defined in the appended claims.

What is claimed is:

1. A publication capable of receiving a pictorial representation of a subject to identify said subject with a particular organization of a plurality of organizations within an association, produced by:

generating image data representative of generic graphic indicia which is related to said association and generic with respect to each of said organizations, said generic graphic indicia including a generic depiction of a member of said association;

enhancing said generic graphic indicia by (a) selecting and distinguishing feature data, which feature data is representative of features within said generic graphic indicia, from the image data representative of said generic indicia, and (b) modifying said selected and distinguished feature data so as to convert said features within said generic graphic indicia into features which are representative of a particular organization within the association and such that the generic depiction of the member of the association is identifiable with said particular organization;

placing said enhanced generic graphic indicia onto page sheets such that the member of the association appears in a plurality of page sheets;

forming in a plurality of sheets a cut-out in a facial area of the enhanced depiction of the member of the association appearing in the plurality of sheets, and said cut-outs being aligned; and assembling said page sheets into a page set; and providing a backing member adapted to support said pictorial representation of said subject in a manner in which a facial portion of said subject is viewable through the aligned cut-outs when said pictorial representation is supported on said backing member.

2. A publication produced in accordance with the process of claim 1 wherein the step of generating image data representative of generic graphic indicia includes scanning artwork and converting the depiction appearing in said artwork into transferable data.

3. A publication produced in accordance with the process of claim 1 wherein the step of modifying said selected and distinguished feature data includes placing said selected and distinguished feature data into individual channels with each channel having a separate feature characteristic and adding coloring data into at least some of said channels in sequential, channel-by-channel fashion.

4. A publication produced in accordance with the process of claim 3 wherein the step of selecting and distinguishing feature data includes outlining a border area of the generic image of the member of the association which is to be enhanced by the addition of color.

5. A publication produced in accordance with the process of claim 4 wherein said generic graphic indica includes a plurality of generic depictions of representative members in said association and the step of enhancing said generic graphic indicia includes selecting and distinguishing feature data from at least some of said depictions and convening the selected and distinguished feature data such that the representative members therein are identifiable with a particular one of said organizations, and said step of enhancing further including placing the selected and distinguished feature data into separate channels with each channel being directed at a particular characteristic of said representative members.

6. A publication produced in accordance with the process of claim 5 wherein said association is a sports league and said organizations are sports teams within said league, and the step of generating image data representative of generic graphic indicia includes generating image data which includes data relating to a generic depiction of a uniformed player within said association, and the step of enhancing said generic graphic image includes converting the generic image of the uniformed player to a player identifiable with a particular one of the teams in said league.

7. A publication produced in accordance with the process of claim 6 wherein the step of enhancing the generic depiction of a uniformed player includes forming channels with data relating to a uniform shirt and a uniform bottom of the uniformed player and providing color to said channels so as to identify the uniformed player with a particular team in the league.

8. A publication produced in accordance with the process of claim 5 wherein the step of enhancing said graphic indicia includes selecting and distinguishing feature data of at least some of said representative members and modifying the feature data so that at least two particular organizations within said association are identifiable through the depiction of said enhanced generic depiction of said representative members, and said modifying of the feature data comprising grouping the feature data of a plurality of channels together and modifying the feature data therein so as to have a common color.

9. A publication produced in accordance with the process of claim 1 wherein said association is a sports league and said organizations are sports teams within said league and the step of generating image data representative of generic graphic indicia includes generating image data which includes data relating to a generic depiction of a uniformed player within said association, and the step of enchancing said generic graphic image includes converting the generic image of the uniformed player to a player identifiable with a particular one of the teams in said league.

10. A publication produced in accordance with the process of claim 1 wherein said process further comprises the step of providing positioning means on said backing member to facilitate proper placement of the pictorial representation when mounted.

11. A publication produced in accordance with the process of claim 10 wherein said process further comprises the step of mounting said pictorial representation on or within said positioning means.

12. A publication capable of receiving a pictorial representation of a subject to identify said subject with a particular team, which team is one of a plurality of teams within a league, comprising:

a plurality of sheets, with a least some of said sheets including graphic indicia depicting uniformed players which are members of a sport league comprised of a plurality of teams;

at least some of said sheets further comprising enchancing indicia which includes coloring and logos for depicting said uniformed players as members of a particular one of said teams in said league;

said uniformed player including a facial area and a plurality of said sheets having a common uniformed player in each, and the facial area of said common individual having a cut-out formed therein which is aligned on at least some of said sheets in which said common individual is depicted;

a support member adapted to support said pictorial representation of said subject which is not a member of said league such that a facial portion in said pictorial representation is aligned with the cut-outs; and pictorial representation positioning means provided on said support member and adapted to ensure proper placement of said pictorial representation.

13. A publication as recited in claim 12 wherein said support member is a front surface of one of said sheets in said plurality of sheets.

14. A publication as recited in claim 13 wherein said positioning means includes added indicia on said support sheet.

15. A publication as recited in claim 12 wherein said page sheets with said cut-outs include a front and rear surface with said enhanced generic graphic indicia provided on both the front and rear surface and the cut-out in each page sheet is provided in the facial area of either said front or rear surface of said page sheet and in a neutral area of the opposite surface of said page sheet.

16. A publication as recited in claim 12, wherein one of said sheets includes a sports card.

* * * * *